US009341022B2

(12) United States Patent
Nicholson

(10) Patent No.: US 9,341,022 B2
(45) Date of Patent: May 17, 2016

(54) SENSING MANUAL DRIVE OPERATION OF A MOVABLE BARRIER

(71) Applicant: Chamberlain Australia Pty Ltd., Lane Cove NSW (AU)

(72) Inventor: Scott James Nicholson, West Gosford (AU)

(73) Assignee: Chamberlain Australia PTY Ltd., Lake Cove NSW (AU)

( * ) Notice: Subject to any disclaimer, the term of this patent is extended or adjusted under 35 U.S.C. 154(b) by 0 days.

(21) Appl. No.: 14/339,519

(22) Filed: Jul. 24, 2014

(65) Prior Publication Data

US 2016/0024830 A1 Jan. 28, 2016

(51) Int. Cl.

| | |
|---|---|
| ***E05F 11/04*** | (2006.01) |
| ***E06B 9/74*** | (2006.01) |
| ***E05F 11/54*** | (2006.01) |

(52) U.S. Cl.

CPC . *E06B 9/74* (2013.01); *E05F 11/04* (2013.01); *E05F 11/54* (2013.01); *E05Y 2900/106* (2013.01)

(58) Field of Classification Search

CPC ..... E05Y 2900/106; E05Y 2900/00; E05Y 2201/244; E06B 9/74

USPC ..... 49/26–28, 139, 140, 197, 199; 74/625; 318/445, 446; 160/310, 133

See application file for complete search history.

(56) References Cited

U.S. PATENT DOCUMENTS

| | | | | |
|---|---|---|---|---|
| 2,819,628 A | | 1/1958 | Wardlaw | |
| 3,637,004 A | * | 1/1972 | Wardlaw | E06B 9/84 160/133 |
| 4,519,487 A | * | 5/1985 | Florin | E60B 9/74 160/319 |
| 4,976,168 A | * | 12/1990 | Lotznicker | E06B 9/74 160/310 |
| 4,976,302 A | * | 12/1990 | Taylor | E06B 9/70 160/310 |
| 5,839,555 A | * | 11/1998 | Hsieh | F16D 67/02 160/310 |
| 6,029,735 A | | 2/2000 | Nicholson | |
| 6,091,217 A | * | 7/2000 | Parsadayan | E05F 15/41 318/283 |
| 6,376,832 B1 | * | 4/2002 | Smith | G01D 5/34792 250/231.14 |
| 6,381,903 B1 | * | 5/2002 | Desrochers | E06B 9/74 160/310 |
| 6,712,116 B2 | * | 3/2004 | Beaudoin | E05D 13/003 160/188 |
| 6,782,662 B2 | * | 8/2004 | McCartney | E05D 13/00 49/197 |

(Continued)

FOREIGN PATENT DOCUMENTS

| | | |
|---|---|---|
| CA | 2297220 | 3/2001 |
| EP | 1028223 | 2/2000 |

OTHER PUBLICATIONS http://www.liftmaster.com/lmcv2/pages/productfamily.aspx?famid=4; LiftMaster Hoist Rolling Door Operator Systems, copyright 2013.

(Continued)

*Primary Examiner* — Katherine Mitchell
*Assistant Examiner* — Justin Rephann
(74) *Attorney, Agent, or Firm* — Fitch, Even, Tabin & Flannery LLP

(57) ABSTRACT

A movable barrier operator is provided that includes a motor coupled to a movable barrier to move the movable barrier, a computing device which controls movement of the motor, a manual drive coupled to the movable barrier to move the movable barrier, a ring coupled to move with the manual drive, and a sensor that senses and communicates rotation of the ring to the computing device. In response to receiving the sensed rotation of the ring, the computing device prevents operation of the motor to move the movable barrier.

12 Claims, 19 Drawing Sheets

(56) References Cited

U.S. PATENT DOCUMENTS

| | | | | |
|---|---|---|---|---|
| 7,061,197 | B1 * | 6/2006 | Mullet | E05F 15/668 318/466 |
| 7,240,582 | B1 | 7/2007 | Manaras | |
| 7,261,139 | B2 * | 8/2007 | Varley | E06B 9/76 160/310 |
| 7,367,160 | B2 * | 5/2008 | Mullet | E05D 13/1261 160/188 |
| 7,481,133 | B2 * | 1/2009 | Walravens | E05F 15/603 49/139 |
| 7,576,504 | B2 * | 8/2009 | Mullet | E05F 15/668 318/445 |
| 7,583,040 | B2 * | 9/2009 | Claudel | E05F 15/70 318/264 |
| 8,069,896 | B2 * | 12/2011 | Magro | E06B 9/72 160/1 |
| 8,100,163 | B2 * | 1/2012 | Nicholson | E06B 9/62 160/296 |
| 8,230,759 | B2 * | 7/2012 | Hsieh | E05D 13/003 160/310 |
| 8,381,442 | B2 * | 2/2013 | Wan | E05F 15/603 160/188 |
| 8,405,337 | B2 * | 3/2013 | Gebhart | H02P 6/002 318/400.01 |
| 8,662,140 | B2 * | 3/2014 | Hsieh | E05F 11/54 160/133 |
| 8,915,287 | B2 * | 12/2014 | Hsieh | E06B 9/78 160/120 |
| 8,985,181 | B2 * | 3/2015 | Hsieh | E06B 9/42 160/133 |
| 2002/0153854 | A1 * | 10/2002 | Reed | E06B 9/68 318/466 |
| 2005/0172559 | A1 * | 8/2005 | Hsieh | E05F 15/40 49/140 |
| 2009/0313898 | A1 * | 12/2009 | Manaras | E06B 9/15 49/31 |
| 2012/0240470 | A1 * | 9/2012 | Leivenzon | E06B 9/74 49/140 |
| 2013/0074409 | A1 * | 3/2013 | Hsieh | E06B 9/80 49/139 |
| 2013/0140130 | A1 * | 6/2013 | Dang | E06B 9/322 192/93 A |

OTHER PUBLICATIONS http://www.manaras.com/operah_op.shtml; Commercial Door Operators, copyright 2011.

Linear Building on Innovation; Installation and Owner's Manual; J-S & H-S; J & H Series with Solid State Control Circuitry Jackshaft Commercial Vehicular Door Operators, Apr. 2011.

Technical Specificationsfor Manaras Opera-H operator parts; dated Aug. 4, 2011.

* cited by examiner

SENSING MANUAL DRIVE OPERATION OF A MOVABLE BARRIER

TECHNICAL FIELD

This invention relates generally to safety features for a movable barrier system used to move a movable barrier, and more specifically to sensing use of a manual drive for a movable barrier.

BACKGROUND

Movable barrier systems are generally known in the industry. Such systems typically include a barrier operator that is used to move an associated barrier. There are several different styles of barrier operators including barrier operators that may be electronically driven under normal operating conditions and additionally may be manually driven. One common manually driven barrier operator device is a chain hoist, though other methods of manual movement are known. The manually driven part of such barrier operator devices are generally used during installation of the movable barrier system, when conducting maintenance or servicing of the movable barrier system, and in the event of emergencies or power failure, in other words, at times when the electrically driven motor is not used.

In certain configurations, the manual chain hoist is coupled to the electronic motor through the use of various devices. Thus, when using the manual chain hoist to open or close the movable barrier, the electronic operator may still be configured to provide power to move the movable barrier and therefore may cause a force to be exerted on the manual chain hoist while a user is still holding onto it. Additionally, after a user engages the manual chain hoist to open or close the movable barrier, the motor may still be configured to open or close the movable barrier based on its own previous operating state. Thus, the motor may attempt to open the movable barrier when it is already in an open configuration, or alternatively attempt to close the movable barrier when it is already in a closed configuration.

BRIEF DESCRIPTION OF THE DRAWINGS

The above needs are at least partially met through provision of the subject matter described in the following detailed description, particularly when studied in conjunction with the drawings, wherein.

Skilled artisans will appreciate that elements in the figures are illustrated for simplicity and clarity and have not necessarily been drawn to scale. For example, the dimensions and/or relative positioning of some of the elements in the figures may be exaggerated relative to other elements to help to improve understanding of various embodiments of the present invention. Also, common but well-understood elements that are useful or necessary in a commercially feasible embodiment are often not depicted in order to facilitate a less obstructed view of these various embodiments. It will further be appreciated that certain actions and/or steps may be described or depicted in a particular order of occurrence while those skilled in the art will understand that such specificity with respect to sequence is not actually required. It will also be understood that the terms and expressions used herein have the ordinary technical meaning as is accorded to such terms and expressions by persons skilled in the technical field as set forth above except where different specific meanings have otherwise been set forth herein.

SUMMARY

Generally speaking, pursuant to these various embodiments, a sensor senses rotation of a ring operably coupled to a manual drive mechanism used to move a movable barrier. The sensor communicates a signal to a computing unit that prevents operation of a motor that otherwise moves the movable barrier. In one approach, the sensor additionally senses the direction of rotation of the ring and communicates this signal to the computing unit. The computing unit uses this information for determining how to next operate the motor.

So configured, such a ring and sensor apparatus can provide increased user safety when operating a manual drive mechanism. By preventing operation of the motor while the user engages the manual drive mechanism, the user may safely engage the manual drive to open and/or close the movable barrier. Additionally, when the computing device determines the first direction of operation of the motor after the manual drive has been used, the movable barrier operator will not control the motor in an incorrect manner, i.e., trying to close the movable barrier when it is already in its closed position or trying to open the movable barrier when the movable barrier is already in its open position and thereby potentially damaging the system. As a result, unnecessary wear and tear on the motor and corresponding components may be reduced or eliminated.

These and other benefits may become clearer upon making a thorough review and study of the following detailed description.

DETAILED DESCRIPTION

Figure 1:
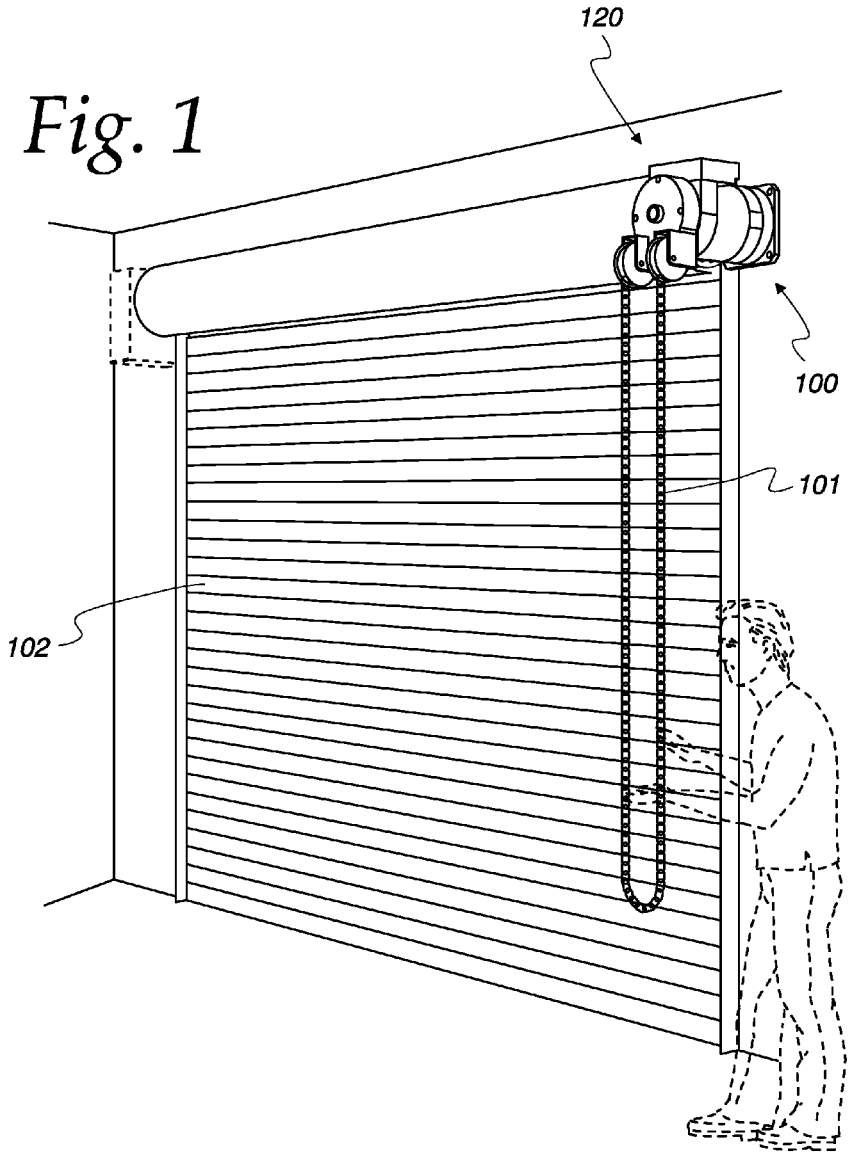
FIG. 1 comprises a perspective view of an example barrier operator system having a manual drive and a sensing apparatus as configured in accordance with various embodiments of the invention.
Figure 2:
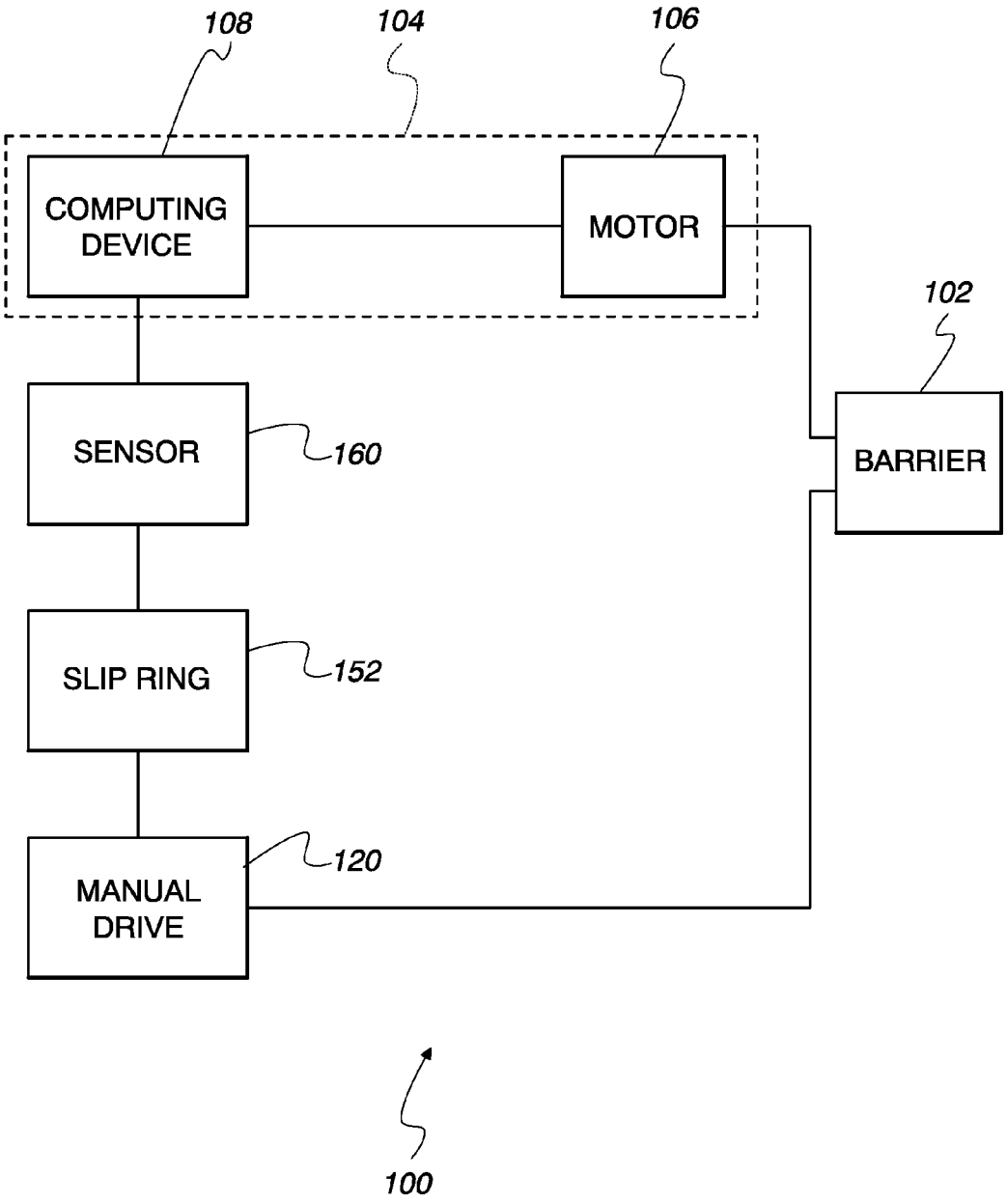
FIG. 2 comprises a block diagram of an example manual drive sensing system as configured in accordance with various embodiments of the invention.
Figure 3:
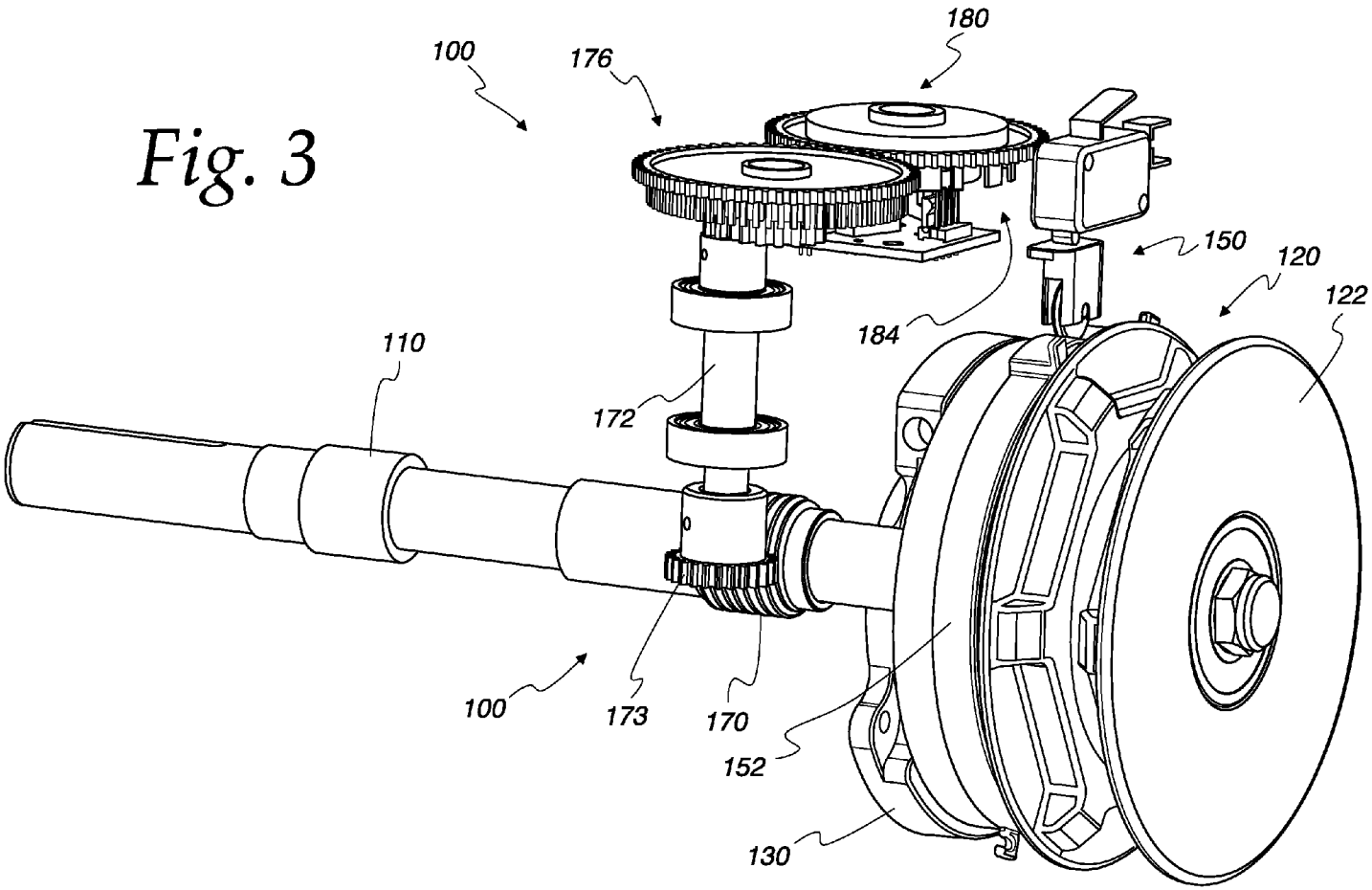
FIG. 3 comprises a front left side perspective view of an example manual drive sensing system as configured in accordance with various embodiments of the invention.
Figure 4:
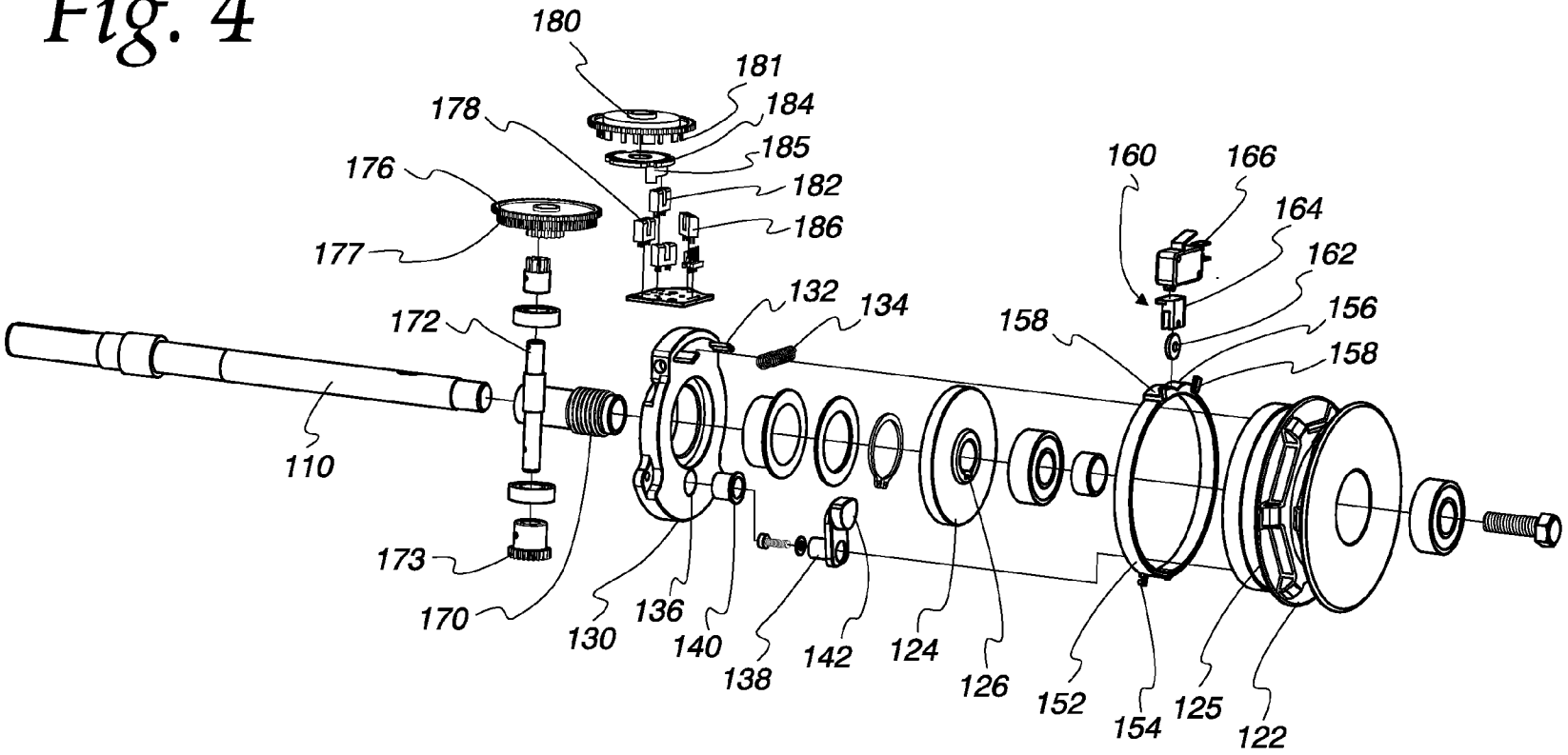
FIG. 4 comprises a front left side exploded perspective view of the example manual drive sensing system of FIG. 3.
Figure 5:
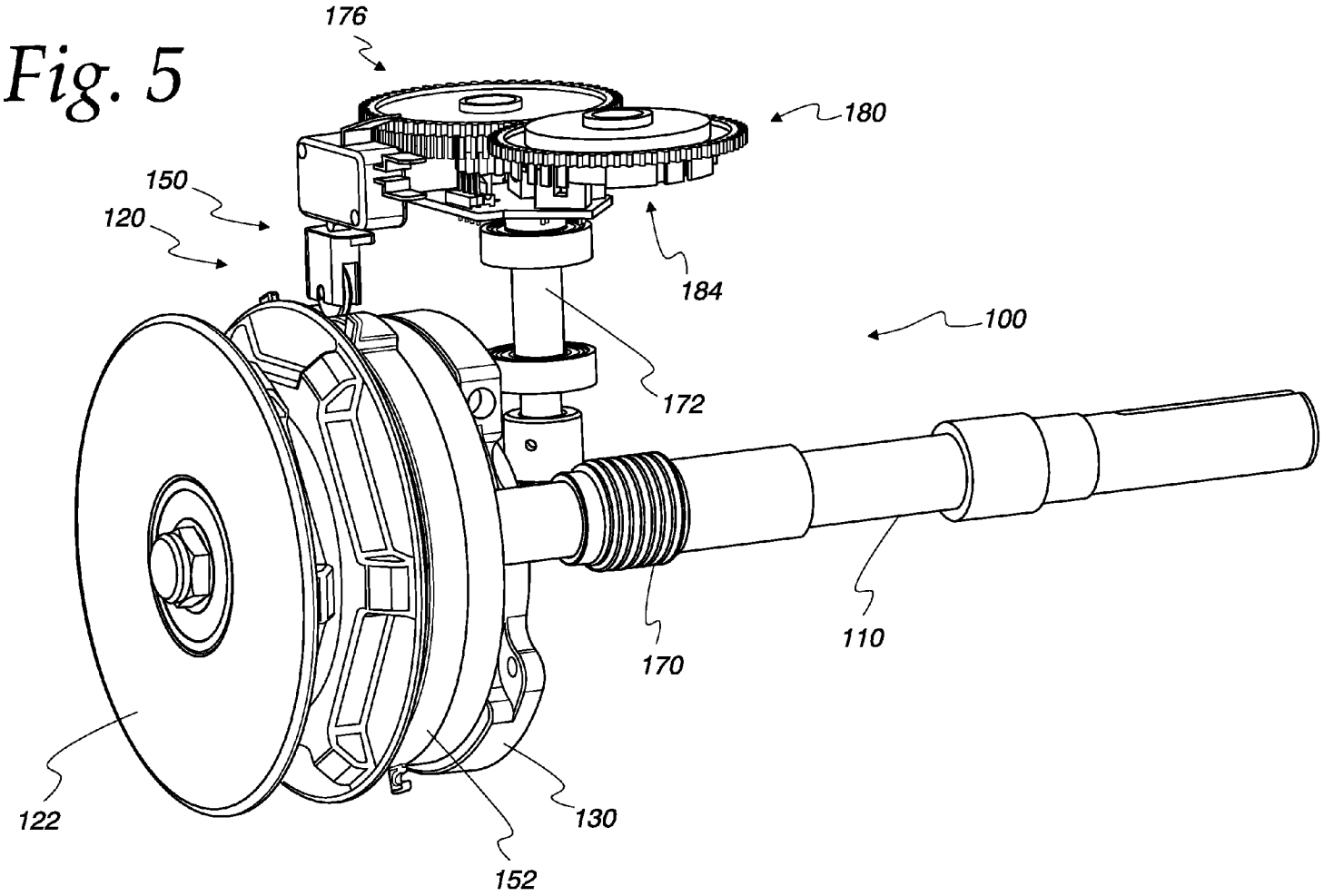
FIG. 5 comprises a front right side perspective view of the example manual drive sensing system of FIG. 3.
Figure 6:
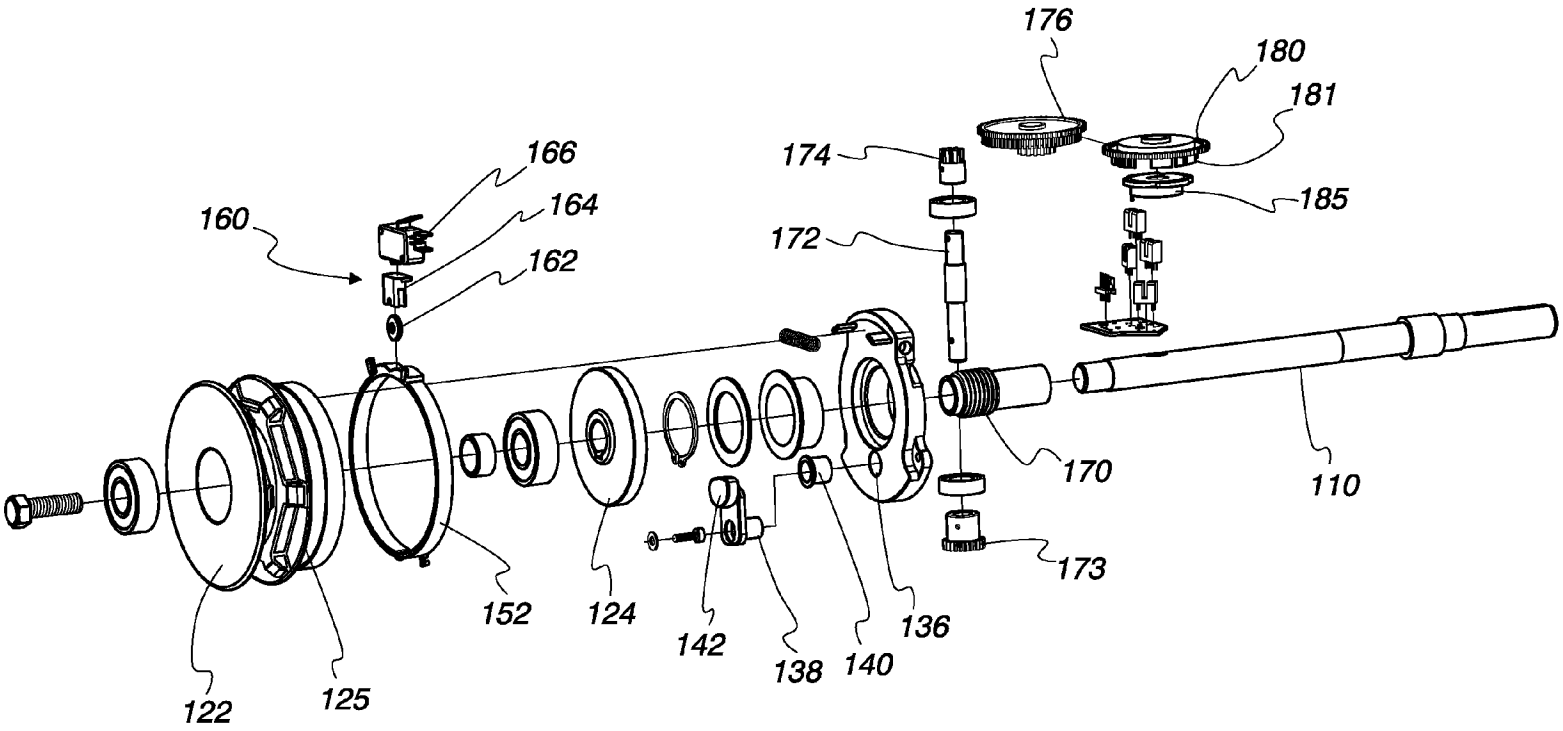
FIG. 6 comprises a front right side exploded perspective view of the example manual drive sensing system of FIG. 3.
Figure 7:
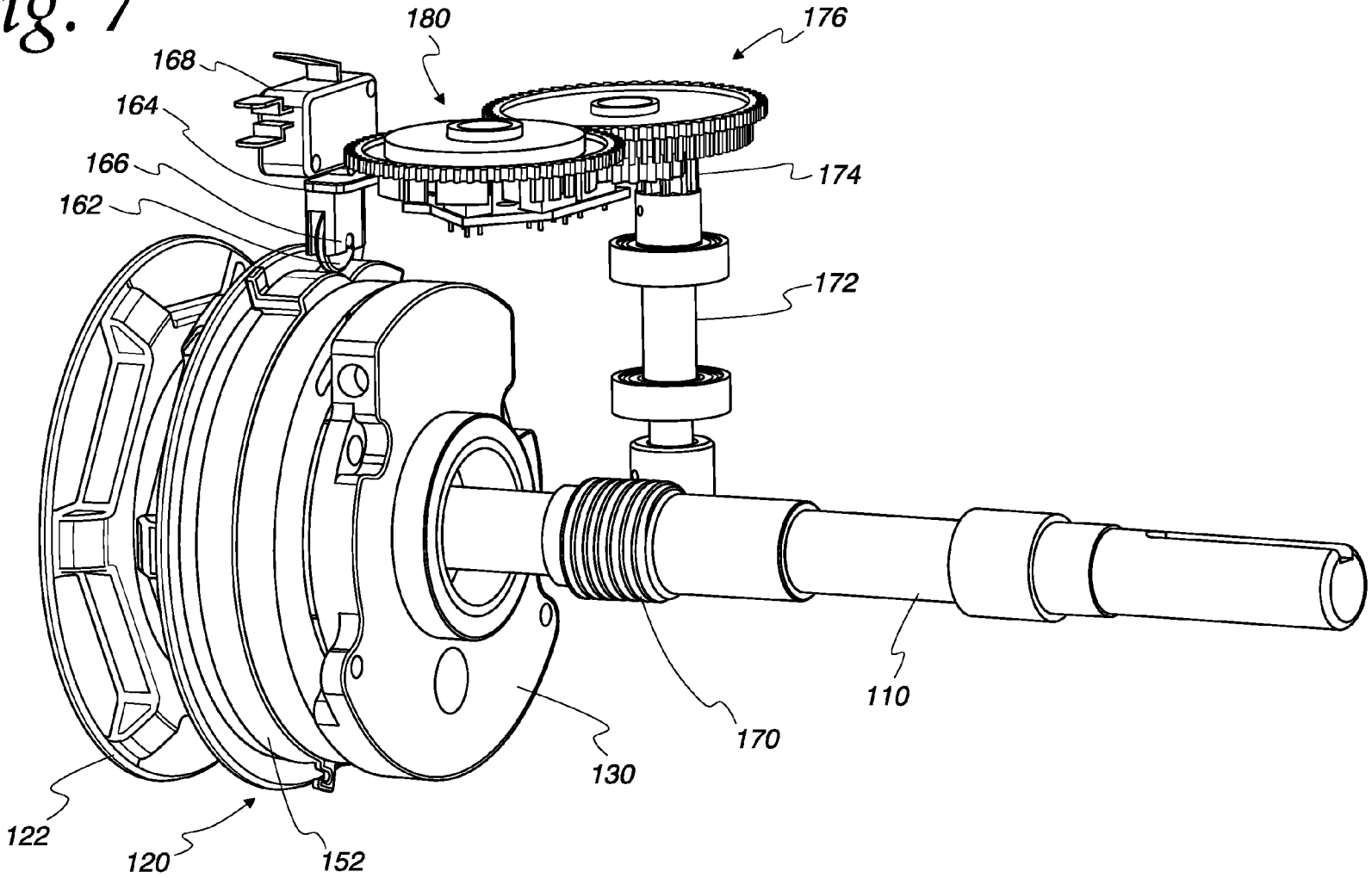
FIG. 7 comprises a rear right side perspective view of the example manual drive sensing system of FIG. 3.
Figure 8:
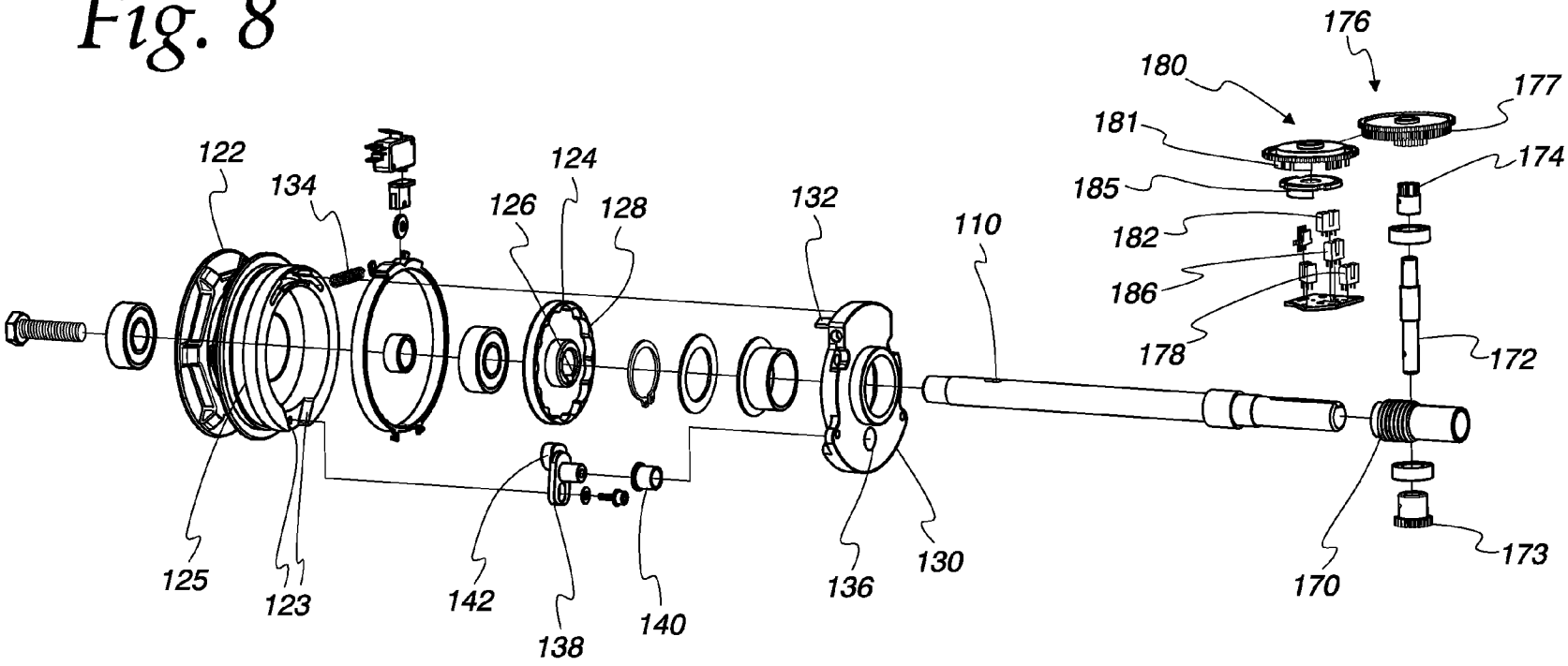
FIG. 8 comprises a rear right side exploded perspective view of the example manual drive sensing system of FIG. 3.
Figure 9:
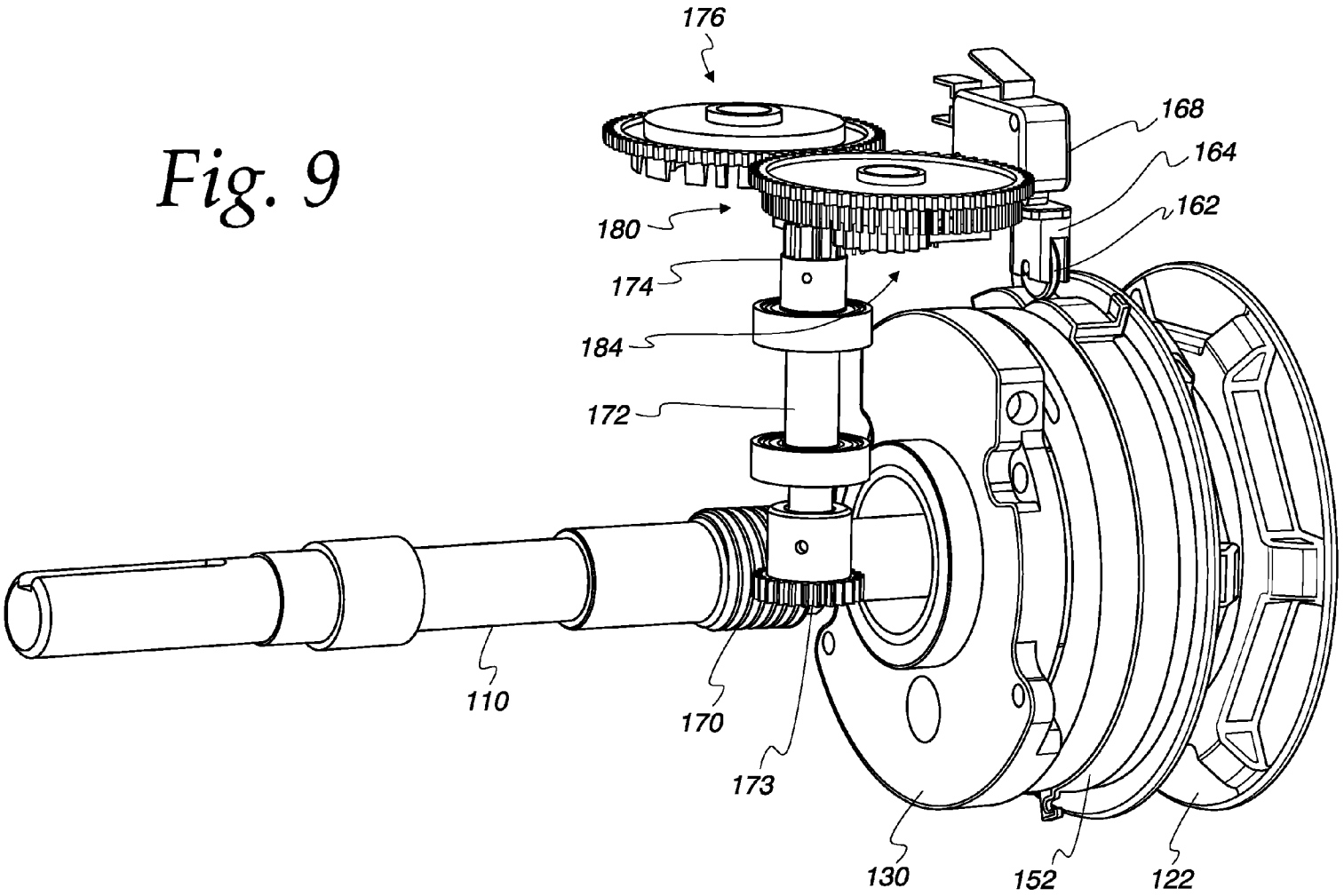
FIG. 9 comprises a rear left side perspective view of the example manual drive sensing system of FIG. 3.
Figure 10:
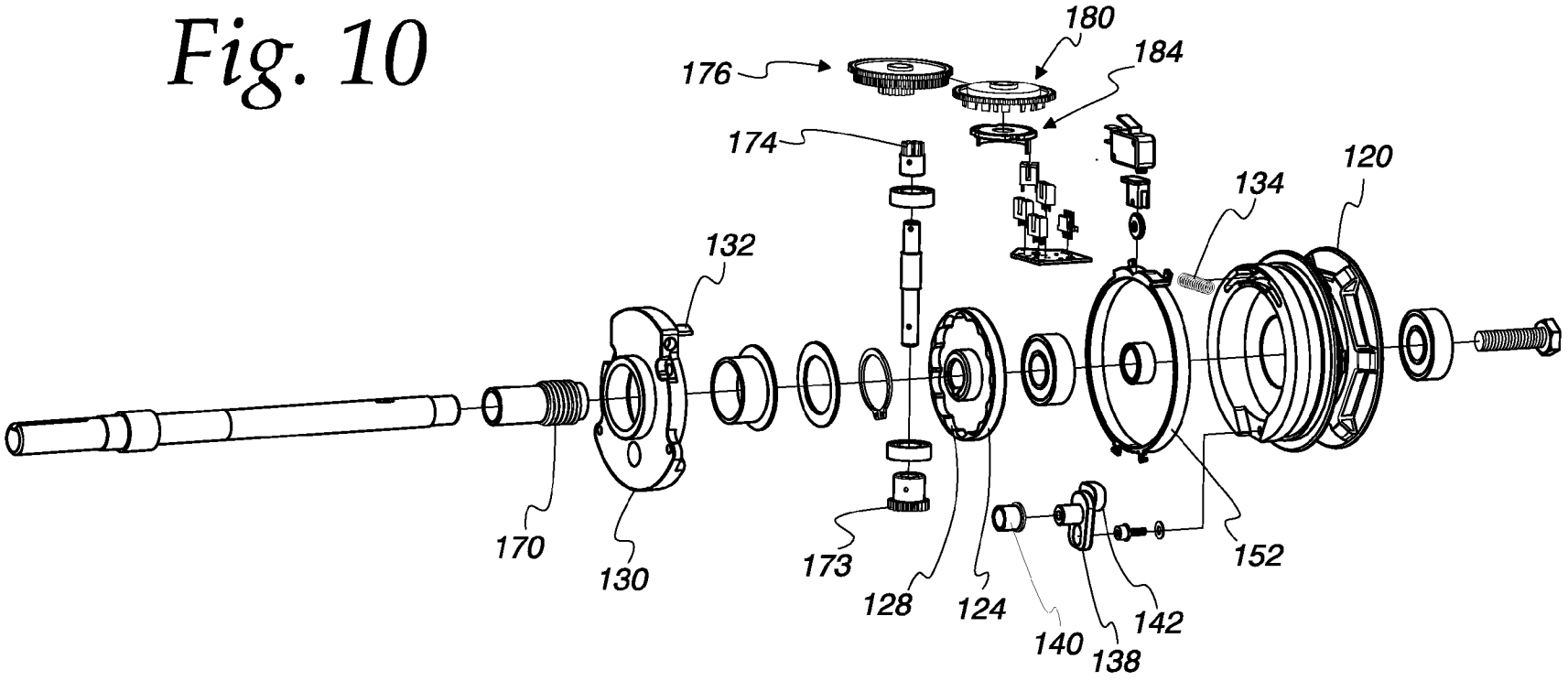
FIG. 10 comprises a rear left side exploded perspective view of the example manual drive sensing system of FIG. 3.

Referring now to the drawings, and in particular to FIGS. 1 and 2, movable barrier operator system 100 can include, for example, a barrier 102, an operator 104, a motor 106, an operator 104, a computing device 108, a drive shaft 110, a manual drive system or mechanism 120, and a sensing system 140. The sensing system 150 can further include a sensor 150 and a ring 152.

The operator 104 includes the computing device 108 and the motor 106. The motor 106 is coupled to the drive shaft 110, which is connected to move the movable barrier 102 in response to operation of the motor 106. It is understood that in some examples, the motor 106 and the computing device 108 are all contained within the same housing, but in other examples, the motor 106 and the computing device 108 are contained in separate housings. In other examples, other combinations are possible.

The manual drive system 120 is also operably coupled to move the movable barrier 102. A ring 152 is operably coupled to the manual drive system 120, and a sensor 160 is disposed to sense a position of the ring 152

In operation, the computing device 108 is configured to control movement of the motor 106. The motor 106 effectuates movement of the movable barrier 102. Such operators 104 and motors 106 and their respective functions are well known in the art, thus for the sake of brevity and the preservation of focus, additional details will not be presented here regarding such well understood peripheral structure.

The manual drive system 120 provides an alternative system of moving of the movable barrier 102. In one example, a user manually operates the manual drive system 120 by pulling on a hand chain that is coupled to the manual drive system 120 to open or close the movable barrier 102.

The computing device 108 is configured to control drive states of the movable barrier operator system 100 during and after operation of manual drive system 120 in response to sensed position of the ring 152. In some examples, the ring 152 is a slip ring 152 that engages a rotatable portion of the manual drive system 120 to move or rotate with the manual drive system 120 during a portion of its travel. The sensor 160 senses rotation of the slip ring 152 and in response, communicates a signal to the computing device 108. In response to receiving this signal, the computing device 108 prevents operation of the motor 106 to move the movable barrier 102.

Referring now to FIGS. 3-11, specific examples of a manual drive system 120 and sensing system 140 are provided. The manual drive system 120 includes a chain wheel 122, drive wheel 124, clutch 130, spring 134, and drive pawl 138. The sensing system 150 includes a ring 152 and a sensor 160. The ring 152 includes a notch 154, guide surface 156, and tab 158. The sensor 160 includes a wheel 162 and housing 164. With brief reference to FIG. 11, the housing 112 includes a detent 114 disposed to engage the tab 158 of the ring 152. The manual drive system 120 and sensing system 150 include additional components illustrated in the figures such as washers, bearings, sleeves, and fasteners which are commonly known and thus will not be discussed in further detail.

A drive shaft 110 is inserted through center bores of the chain wheel 122, drive wheel 124, clutch 130, and slip ring 152, thus axially aligning these components. The drive wheel 124 includes a keyed center bore 126, which accepts a protrusion in the drive shaft 110 to rotatably couple these components. Accordingly, the drive shaft's 110 rotation drives the drive wheel 124, and reciprocally, the drive wheel's 124 rotation drives the drive shaft 110.

At least a portion of the drive wheel 124 is contained within an opening of the chain wheel 122. The drive wheel 124 is configured such that when the motor 106 is controlling movement of barrier 102 by rotating the drive shaft 110 and drive wheel 124, the drive shaft 110 and drive wheel 124 rotate independently from the chain wheel 122. As discussed below, the chain wheel 122, however, operatively couples to the drive wheel 124 when the manual drive 120 is used.

The clutch 130 includes a lower bore 136, which is configured to accept a drive pawl 138 via a sleeve bearing 140 inserted into the lower bore 136. The drive pawl 138 is also rotatably coupled to the chain wheel 122, and the pawl cam 142 extends into an opening defined by the chain wheel 122 and the drive wheel 124. The spring 134 is positioned within a cavity defined by the chain wheel 122. The clutch 130 also includes tabs 132, which are also inserted into the cavity defined by the chain wheel 122. These tabs 132 are positioned at opposing ends of the spring 134.

When a user engages the manual drive 120, the chain wheel 122 begins to rotate, and the ledges 123 of the chain wheel 122 contact a side of the drive pawl 138 causing it to rotate about the rotatable connection between the two. The pawl cam 142 then rotates into a drive pocket 128 on drive wheel 124, rotatably coupling the chain wheel 122 and drive wheel 124. Accordingly, because the drive wheel 124 and drive shaft 110 are rotatably coupled to each other, the drive shaft 110 rotates and effectuates movement of the movable barrier 102.

Because the tabs 132 of the clutch 130 and spring 134 are inserted into the cavity defined by the chain wheel 122, rotation of the chain wheel 122 causes an edge of the cavity defined by the chain wheel 122 to contact one of the tabs 132, which in turn rotates the clutch 130 with the drive wheel 122. Rotation of the chain wheel 122 additionally causes the spring 134 to be biased against one of the tabs 132. Upon releasing the hand chain 101, the spring 134 decompresses and exerts a force on the tabs 132 to move the clutch 130 to a relaxed position. This movement causes the drive pawl 138 in lower bore 136 to rotate to an upright position that disengages the drive pockets 128. Accordingly, upon releasing the pull chain 101, the drive mechanism 120 disengages from the drive shaft 110 such that the motor 106 may subsequently operate the movable barrier 102 without also actuating the manual drive system 120.

The sensing system 150 includes the slip ring 152 and the sensor 160. We refer to a "slip ring" in this description because of the described ring's ability to readily slip over and engage a portion of the drive system without significant modification of the system's component. A "ring" is understood as any addition to or modification of the drive system component to facilitate sensing of the drive shaft's 110 rotation and or direction of rotation. For example, a drive system component could be modified to have a guide surface that triggers a sensor similarly to the example illustrated in the figures.

The illustrated slip ring 152 includes notches 154, a spring 155 (see FIGS. 13-16), a guide surface 156, and tabs 158. The example sensor 160 includes a wheel 162 and housing 164. Other sensor types can be employed.

In one example illustrated in FIGS. 13-16, the slip ring 152 is constructed of an elastic ring that terminates at two ends connected by a spring 155 that engages the notches 154. The guide surface 156 includes a lowered midpoint portion 157 connected to ramped portions 159 that terminate at the tabs 158.

Figure 15:
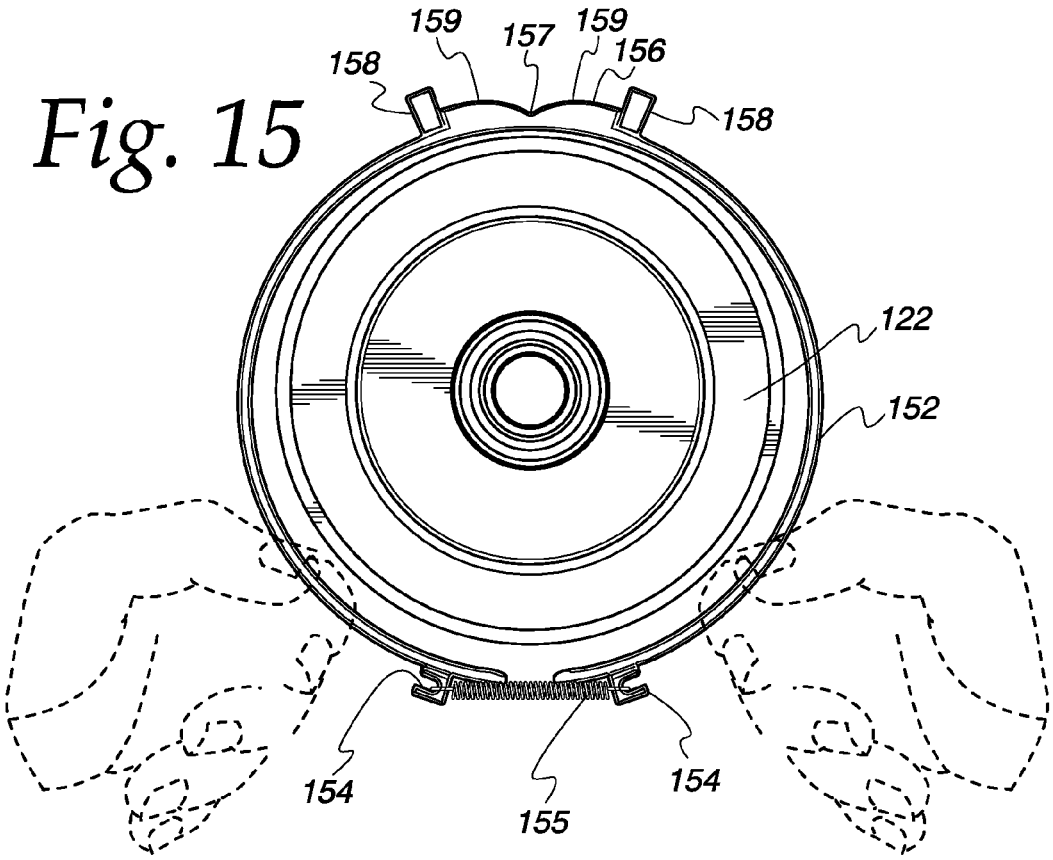
FIG. 15 comprises a front elevation view of the slip ring of FIG. 14 being inserted on the end belle of a manual drive sensing system as configured in accordance with various embodiments of the invention.
Figure 16:
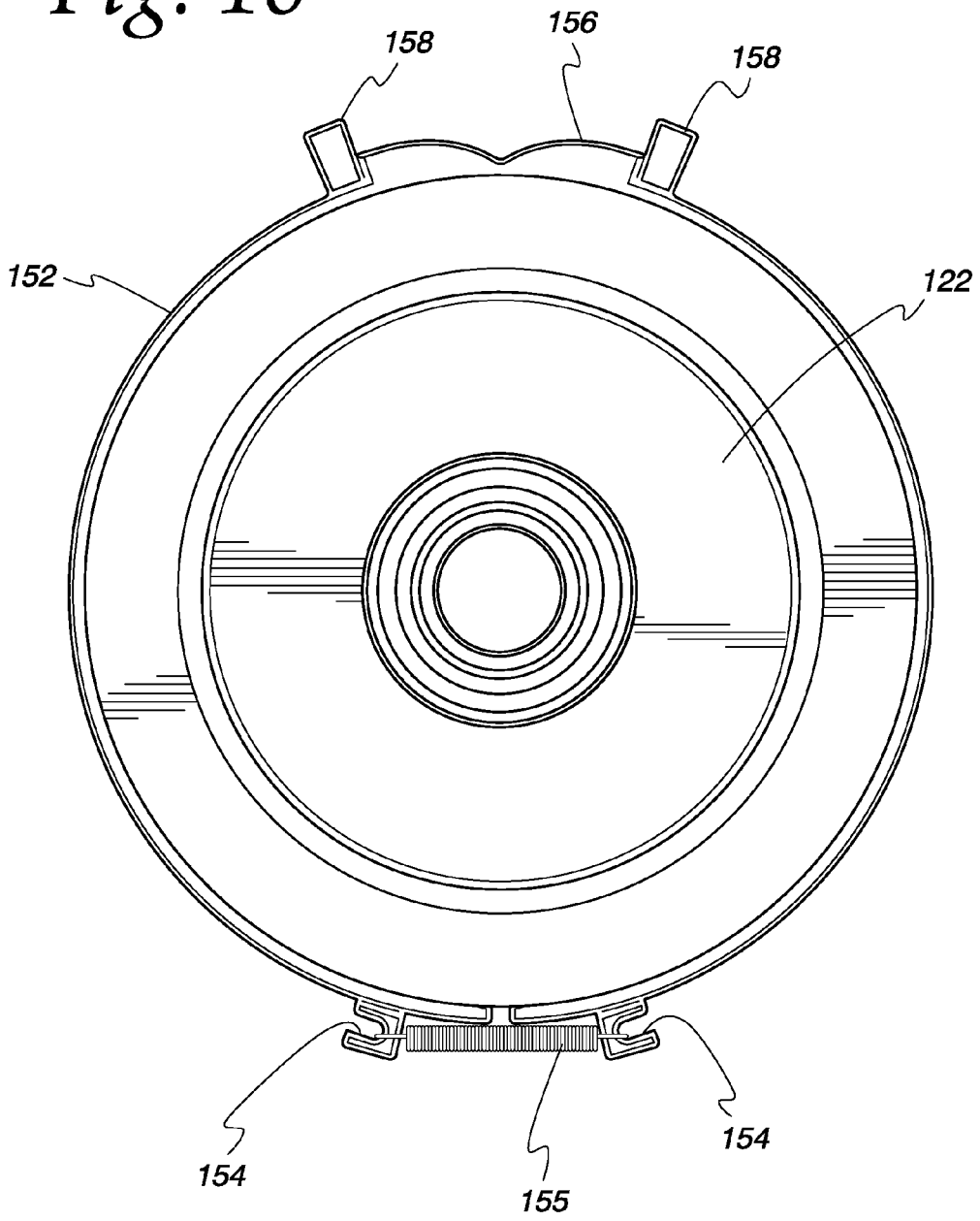
FIG. 16 comprises a front elevation view of the slip ring of FIG. 14 inserted on the end belle of an example manual drive sensing system as configured in accordance with various embodiments of the invention.
Figure 17:
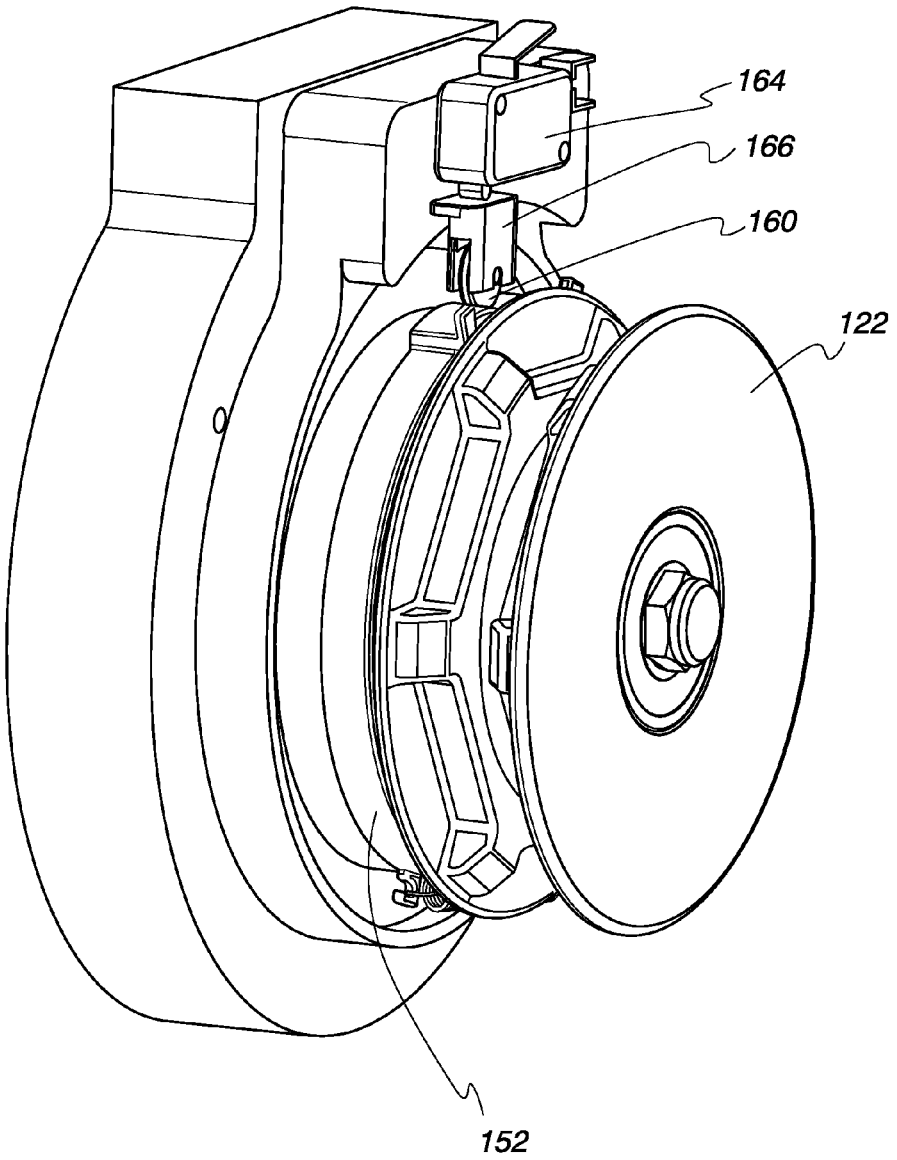
FIG. 17 comprises a perspective view of a portion of the example manual drive sensing system as configured in accordance with various embodiments of the invention.

The slip ring 152 has an internal diameter that engages a rotatable portion of the manual drive 120, here surface 125 on the chain wheel 122 (as seen in FIGS. 4, 6, 8, 10, and 12). As seen in FIGS. 15 and 16, the slip ring 152 is expanded and placed over the chain wheel 122. Then, the spring 155 biases the slip ring 152 to engage the chain wheel 122 with sufficient frictional force such that the slip ring 152 rotates with the chain wheel 122 but is also slidable over the chain wheel 122 in response to tabs' 158 engaging a stop or detent 114 of the housing 112 (see FIG. 11).

The sensor 160 senses rotation of the slip ring 152, which rotation corresponds to rotation of the manual drive 120. The wheel 162 is partially supported by and protrudes from the housing 164, which includes a biasing member to bias the wheel 162 in its protruding configuration to engage the slip ring 152. The wheel 162 includes an axle extending therefrom that is inserted into a channel in the housing 164, which serves to guide the wheel 162 during movement. A trigger (not shown) is contained within the housing 164 to sense when wheel 162 is displaced into housing 164.

Figure 18:
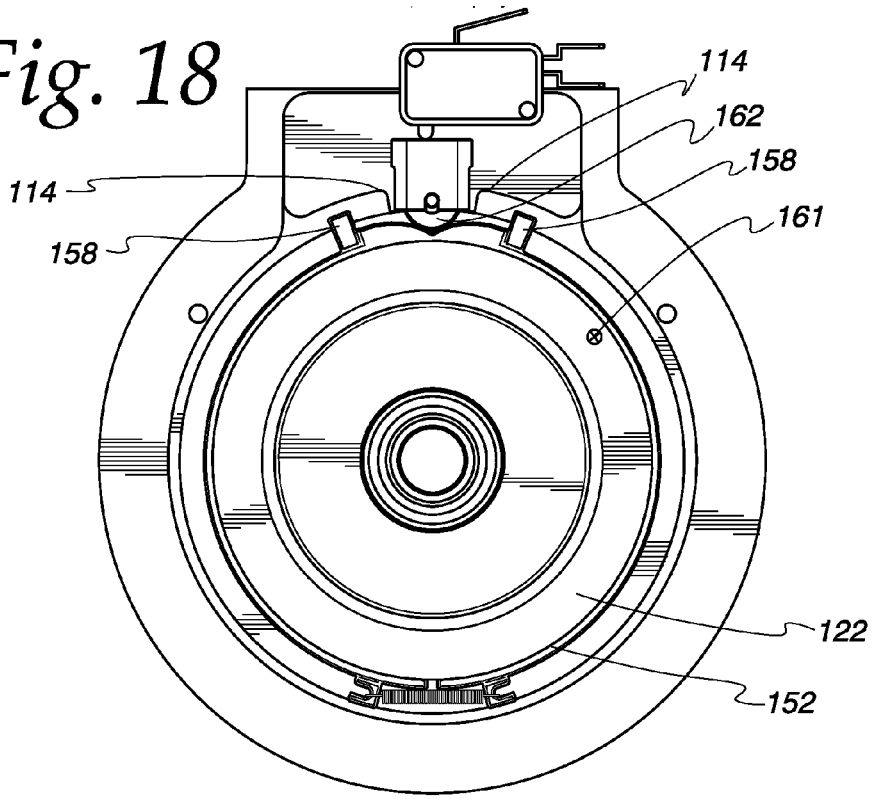
FIG. 18 comprises a front elevation view of an example manual drive sensing system in a resting configuration as configured in accordance with various embodiments of the invention.

As seen in the example illustrated in FIG. 18, in its relaxed, non-displaced state, the wheel 162 rests in the lowed midpoint portion 157. Upon rotating the chain wheel 122 counter-clockwise (see FIGS. 19 and 20) or clockwise (see FIGS. 21 and 22), the wheel 162 traverses the ramped portion 159 of the slip ring 152 and is partially displaced into the housing 164. The trigger then senses and registers this displacement, which indicates rotation of the chain wheel 122. The sensor 160 communicates this signal to the computing device 108. Accordingly, the movable barrier operator system 100, specifically the computing device 108, determines subsequent operation of the motor 106.

Figure 11:
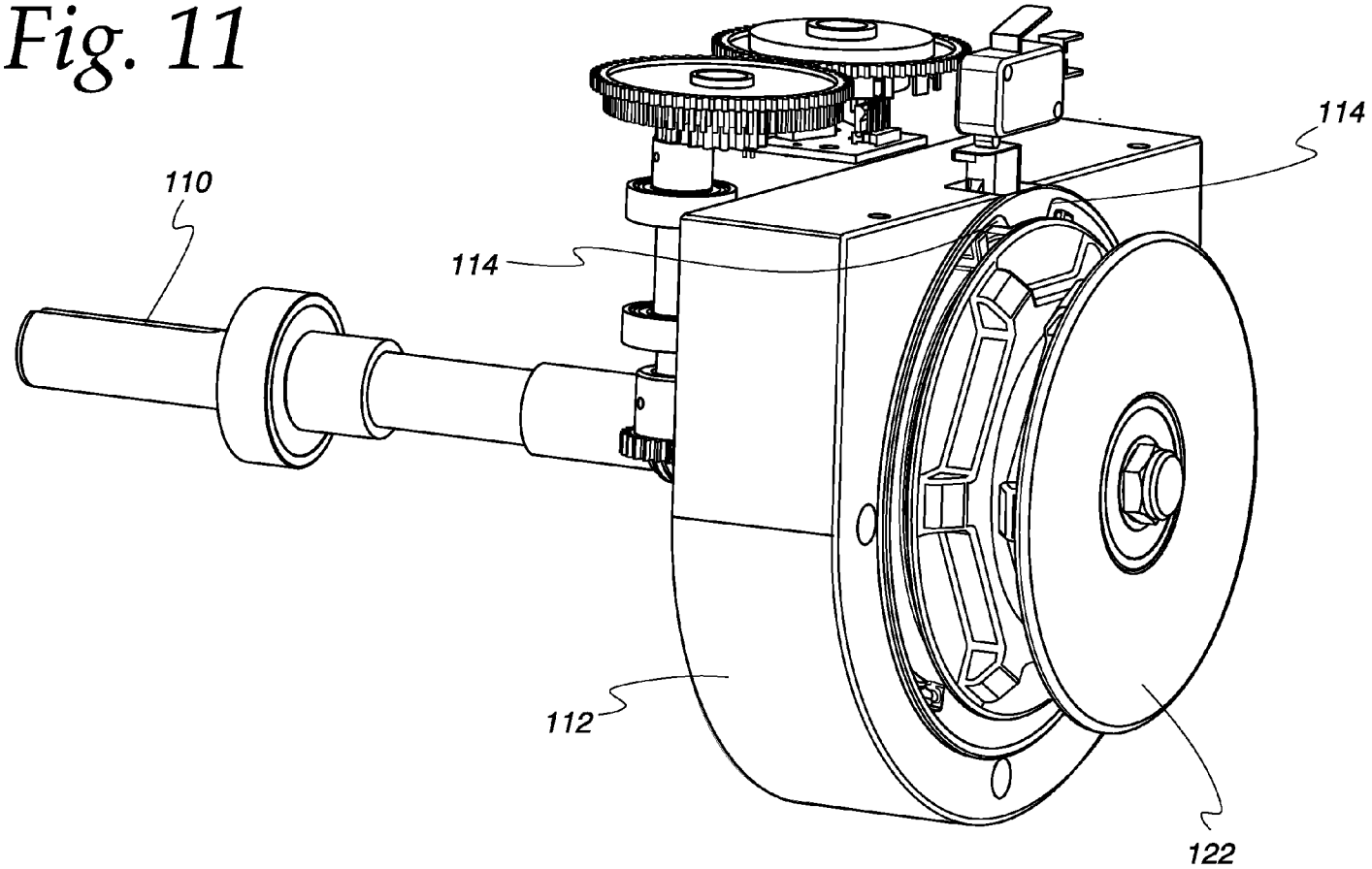
FIG. 11 comprises a front left side perspective view of the example manual drive sensing system of FIG. 3.
Figure 12:
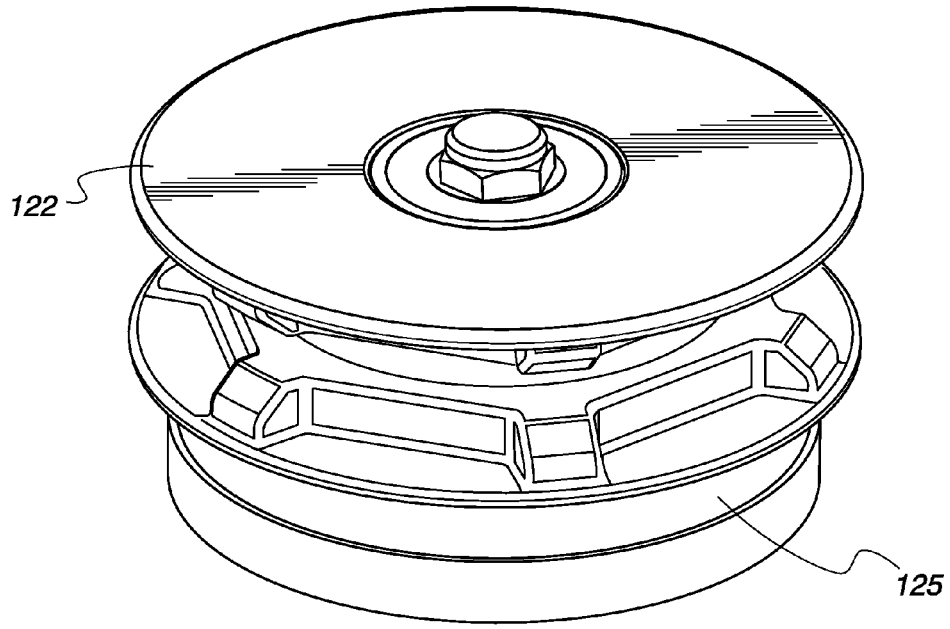
FIG. 12 comprises a perspective view of a chain pulley wheel of an example manual drive sensing system as configured in accordance with various embodiments of the invention.
Figure 13:
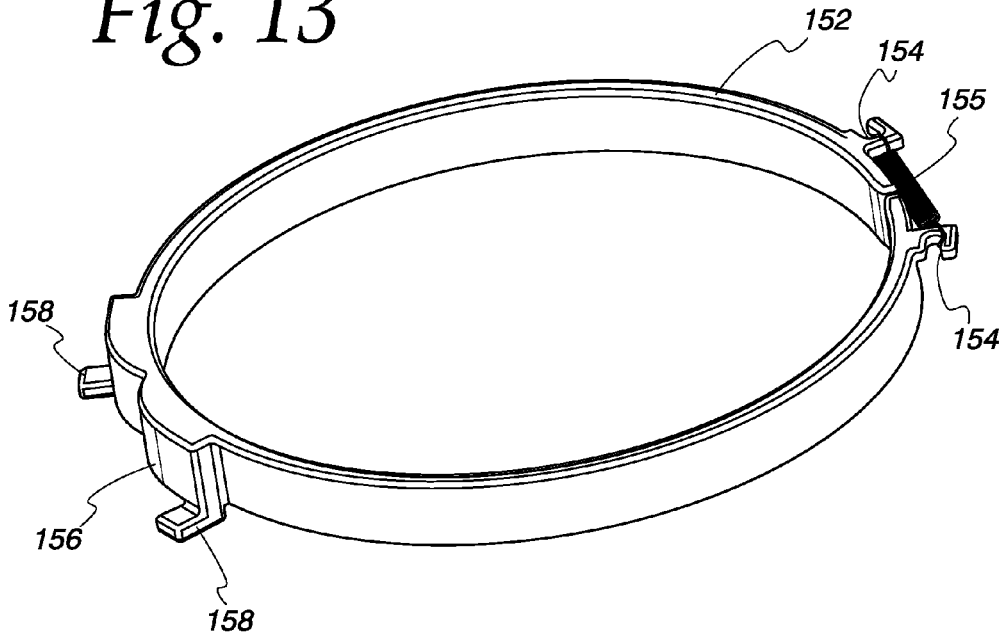
FIG. 13 comprises a perspective view of a slip ring of an example manual drive sensing system as configured in accordance with various embodiments of the invention.
Figure 14:
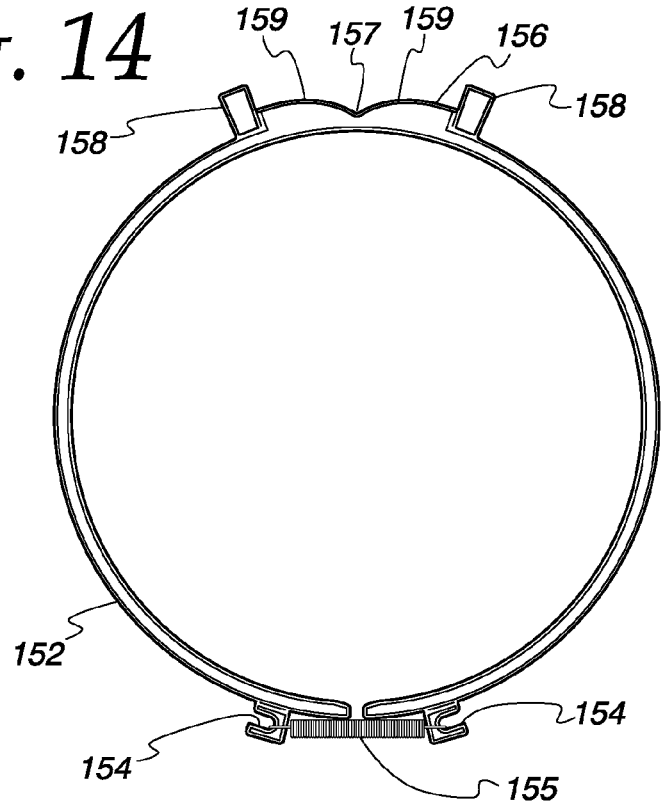
FIG. 14 comprises a front elevation view of a slip ring of an example manual drive sensing system as configured in accordance with various embodiments of the invention.
Figure 19:
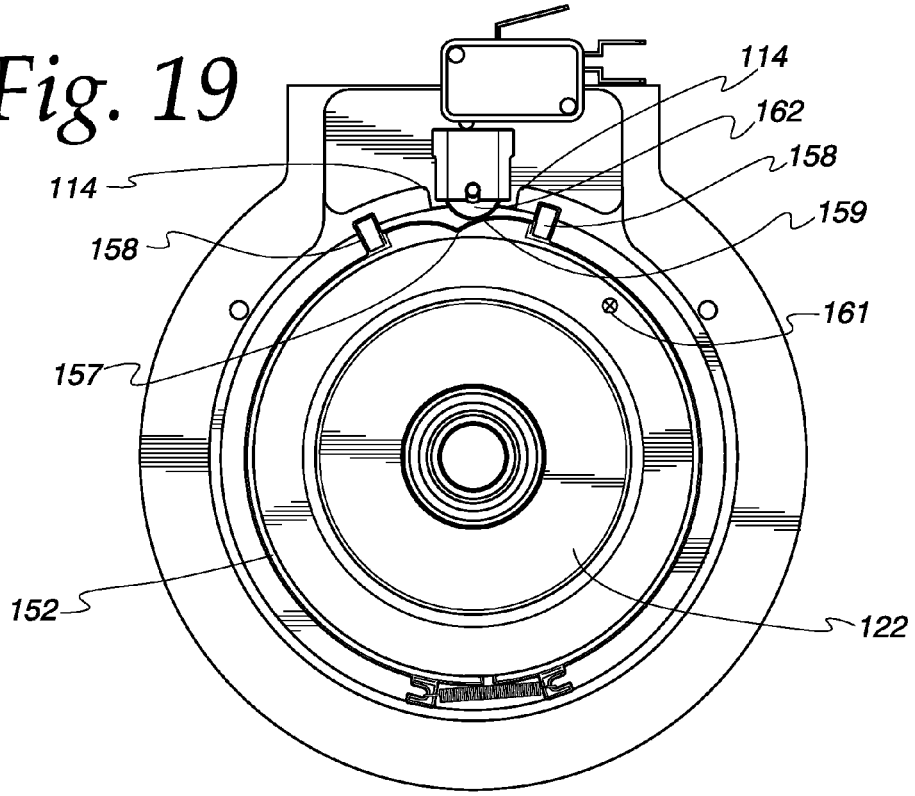
FIG. 19 comprises a front elevation view of the example manual drive sensing system of FIG. 18 rotated in a first direction as configured in accordance with various embodiments of the invention.
Figure 20:
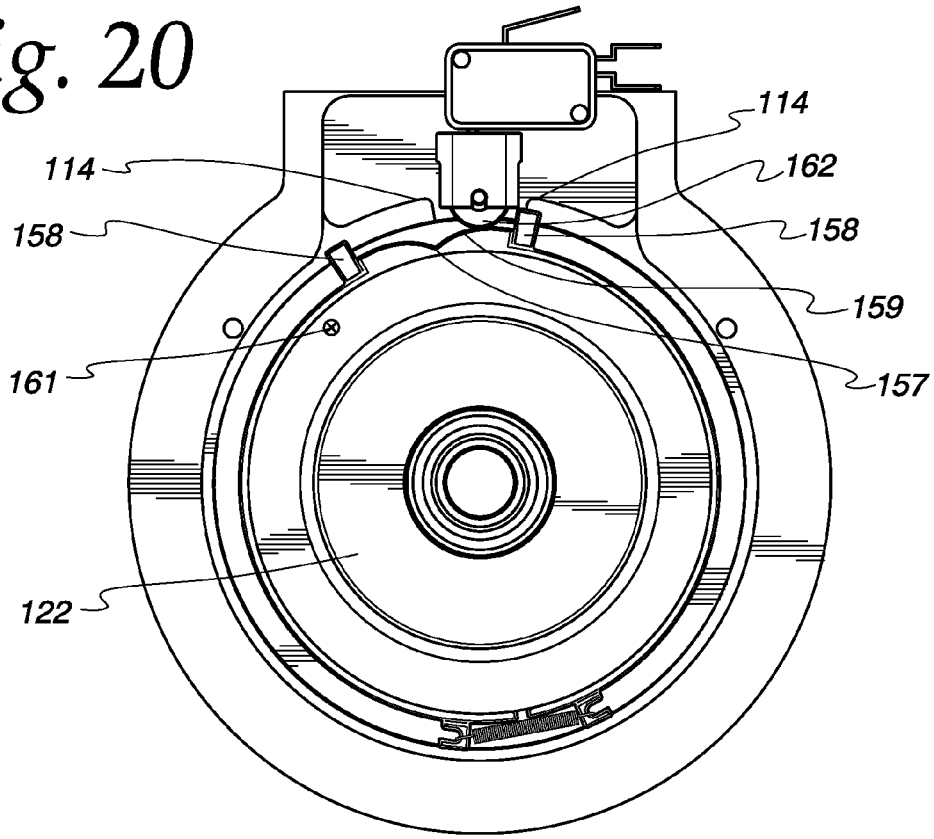
FIG. 20 comprises a front elevation view of the example manual drive sensing system of FIG. 18 being further rotated in the same direction as in FIG. 18 as configured in accordance with various embodiments of the invention.

With reference to FIGS. 11 and 18-22, additional examples of further operation of the sensing system 150 are described. A marker 161 is provided on the chain wheel 122 to better illustrate relative movement of the chain wheel 122 and slip ring 152. In FIG. 19, upon rotating the chain wheel 122 counter-clockwise, both the slip ring 152 and the chain wheel 122 rotate in the counter-clockwise direction. As seen in FIG. 20, a tab 158 of the slip ring 152 comes in contact with a detent 114, which limits further rotation. At this point, the chain wheel 122 continues to rotate in the counter-clockwise direction while sliding along the stationary slip ring 152, thus marker 161 is illustrated in a further counter-clockwise position. Accordingly, a user may continue to actuate the chain 101 supported by the chain wheel 122, thus operating the manual drive 120, while the slip ring 152 remains stationary after rotating a short distance. This small amount of displacement allows the slip ring 152 to quickly signal the computing device 108 and limit the possibility of the motor 106 engaging during manual operation. In some examples and as seen in FIG. 11, the detent 114 is an integral part of housing 112. In other examples and as seen in FIGS. 18-22, the detent 114 is an integral part of manual drive 120 or any other suitable component.

When the user is no longer engaging the manual drive 120, the spring 134 applies a force against the tabs 132 of the clutch 130, which causes the clutch 130 to rotate to a relaxed position. This rotation causes the chain wheel 122 to also move to a relaxed position, which in turn causes the slip ring 152 to rotate to a position where the wheel 162 rests in the lowered midpoint portion 157. Accordingly, the slip ring 152 returns to a position in which the trigger does not sense rotation of the slip ring 152 when the manual drive 120 is not engaged to move the barrier 102.

Figure 21:
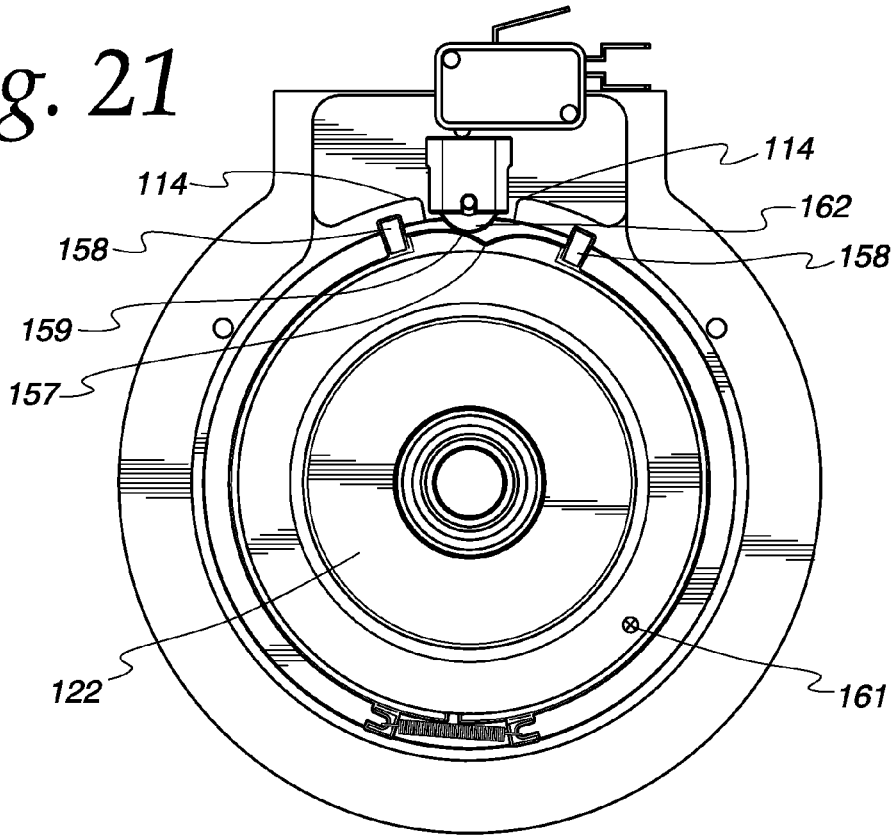
FIG. 21 comprises a front elevation view of the example manual drive sensing system of FIG. 18 rotated in a second direction as configured in accordance with various embodiments of the invention.
Figure 22:
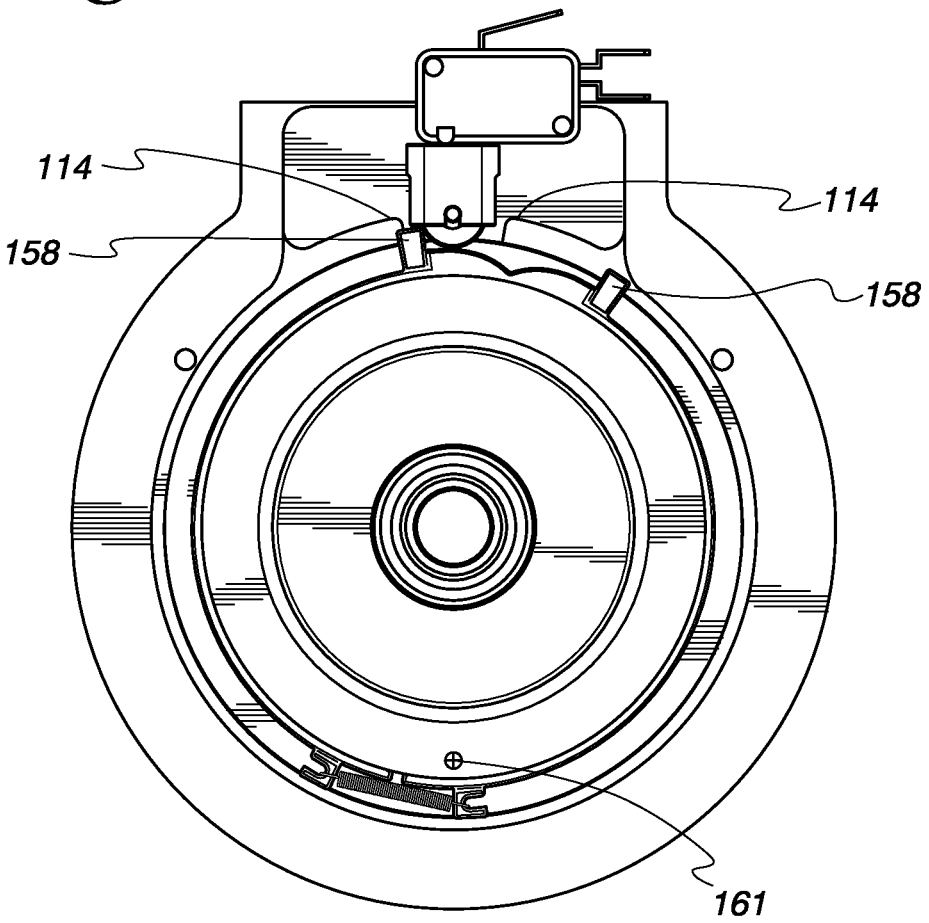
FIG. 22 comprises a front elevation view of the example manual drive sensing system of FIG. 18 being further rotated in the same direction as in FIG. 21 as configured in accordance with various embodiments of the invention.

As seen in FIGS. 21 and 22, rotation of the chain wheel 122 in the clockwise direction similarly causes a tab 158 of the slip ring 152 to engage a detent 114 on the manual drive 120, which limits further rotation of the slip ring 152, but allows the chain wheel 122 to continue to rotate in the clockwise direction.

In some aspects, the movable barrier operator system 100 may have additional sensing capabilities. For example, as illustrated in FIGS. 3-11, movable barrier operator system 100 may include a sensor configured to sense direction of rotation of the slip ring 152, which rotation corresponds to a direction of rotation of manual drive 120. For example, the sensor 160 may sense which of the two tabs 158 approaches the sensor 160, where each tab 158 corresponds to a particular rotational direction. In response to sensing the direction of the rotation of the slip ring 152, the sensor then communicates the signal including an indication of direction of the rotation of the slip ring 152 to computing device 108. In response to receiving this indication of direction of rotation of slip ring 152, the computing device 108 may then determine a first direction of operation of motor 106 after operation of manual drive 120.

Alternatively, a separate sensing system can detect direction of rotation of the drive shaft 110. In one such approach illustrated in FIGS. 3-11, the movable barrier operator system 100 includes a worm 170, sensor shaft 172, speed sensing system 176, position sensing system 180, and direction sensing system 184. The sensor shaft 172 may further include a sensor shaft gear 173 and a sensor shaft drive gear 174. The speed sensing system 176 may include speed sensing system teeth 177 and speed tooth sensor 178. The position sensing system 180 may include position sensing system teeth 181 and position tooth sensor 182. The direction sensing system 184 may include a direction system tooth 185 and a direction tooth sensor 186.

The worm 170 is coupled to rotate with the drive shaft 110 and to engage and drive the sensor shaft gear 173 that is connected to the sensor shaft 172. The sensor shaft drive gear 174 is coupled to an opposing end of the sensor shaft 172 and engages gear teeth on the speed sensing system 176. The position sensing system 180 engages the speed sensing system 176 with a second set of gear teeth. The direction sensing system 184 is axially aligned with and coupled to the position sensing system 180.

The speed tooth sensor 178, position tooth sensor 182, and direction tooth sensor 186 each may be any type of sensor capable of sensing the respective teeth associated with the sensors. In one example, the speed tooth sensor 178, the position tooth sensor 182, and the direction tooth sensor 186 are optical sensors triggered when an object passes through the opening defined by sensors' respective prongs. In other examples, other types of sensors are used.

In operation, upon rotation of the drive shaft 110, the worm 170 rotates therewith causing the sensor shaft gear 173 to rotate. The sensor shaft gear's 173 rotation turn causes the sensor shaft 172 and the sensor shaft drive gear 174 to rotate. Thus, the speed sensing system gear rotates, and the speed sensing system teeth 177 pass through the speed tooth sensor 178, which generates signals corresponding to the speed in which the speed sensing system teeth 177 travel through a space defined by the speed tooth sensor 178. Speed sensing system 176 then communicates this information to computing device 108, which can analyze the information to determine a speed of the movable barrier 102.

In further operation, rotation of the speed sensing system 176 causes rotation of the position sensing system 180 and the direction sensing system 184. The position sensing system teeth 181 are dimensioned with varying lengths and intermediate spaces such that position tooth sensor 182 senses different lengths of signals depending on how far the drive shaft 110 has rotated in a given direction. Accordingly, the position sensor 182 communicates information indicating approximate movable barrier 102 position.

In yet further operation, the direction sensing system tooth 185 rotates in response to rotation of the drive shaft 110. The direction sensing tooth 185 is dimensioned such that it is either located in the space defined by the direction tooth sensor 186 or outside of this space. In one example, when the direction sensing tooth 185 is located in the space defined by the direction tooth sensor 186, the movable barrier 102 has most recently moved toward the closed position. Conversely, when the direction sensing tooth 185 is not located in the space defined by the direction tooth sensor 186, the movable barrier 102 has most recently moved toward the open position. Accordingly, the direction tooth sensor 186 communicates information indicating the direction in which the movable barrier 102 most recently moved based on the sensed information.

It will be appreciated that the opposite configuration of the direction sensing system tooth 185 relative to the direction tooth sensor 186 may also be utilized, meaning an open movement of the movable barrier 102 would be represented by the direction sensing tooth being located in the space defined by the direction tooth sensor 186.

The use of these additional sensors thus allow the movable barrier operator system 100 to determine the traveling speed and/or the approximate position of the movable barrier 102, and/or the movable barrier's 102 most recent direction of movement. For example, if a user engages the manual drive system 120 to open movable barrier 102 (i.e., moving from a closed to an open position), the computing device 108 determines that the movable barrier 102 most recently moved toward the open position. In the event the motor 106 is subsequently used to effectuate movement of the movable barrier 102, the computing device 108 correctly instructs the motor 106 to move the movable barrier 102 to the closed position.

Figure 23:
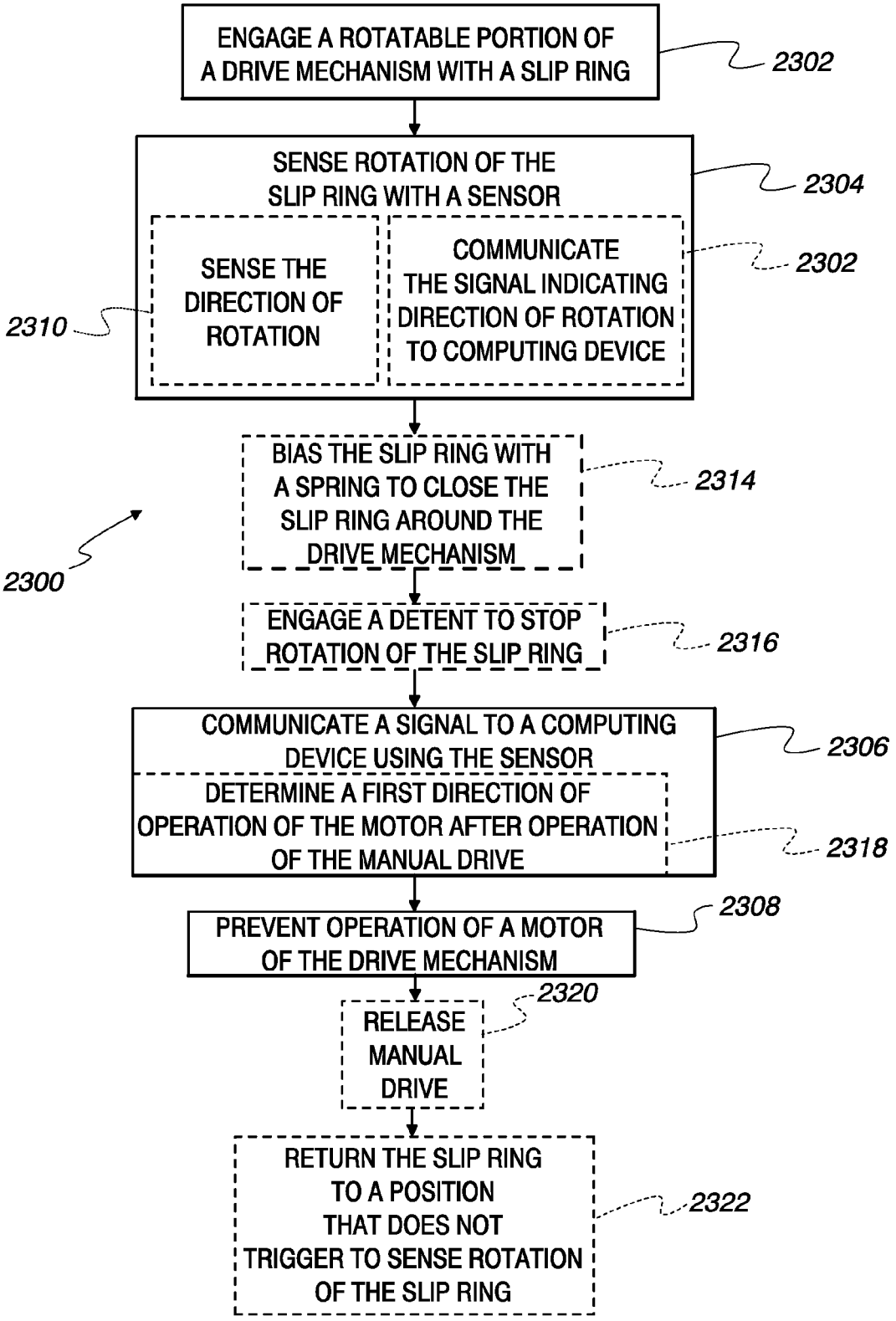
FIG. 23 comprises flow chart illustrating an example method for controlling motor drive states of a movable barrier operator during and after operation of a manual drive mechanism as configured in accordance with various embodiments of the invention.

Referring now to FIG. 23, a method 2300 for controlling motor drive states of a movable barrier operator during and after operation of a manual drive mechanism is provided in further detail. First, at step 2302, a slip ring 152 engages a rotatable portion of a manual drive mechanism 120. At step 2304, a sensing system 150 senses rotation of the slip ring 152. Next, at step 2306, the sensing system 150 communicates a signal to a computing device 108. Finally, at step 2308, the computing device 108 prevents, in response to receiving the signal, operation of the motor 106 to move the movable barrier 102.

In an alternative example, the step of sensing 2304 rotation of the slip ring 152 further includes sensing 2310 the direction of rotation of the manual drive and communicating 2312 the signal indicating direction of rotation. The step of communicating 2306 a signal to a computing device 108 may also include determining 2318 a first direction of operation of the motor 106 after operation of the manual drive system 120. Additionally, the method 2300 may include the steps of biasing 2314 the slip ring 152 with a spring 155 to close the slip ring 152 around a portion of the manual drive mechanism 120, and engaging 2316 a detent 114 to stop rotation of the slip ring 152. After the step of preventing operation of a motor of the drive mechanism 2308, the method 2300 may further include the steps of releasing 2320 the manual drive system 120 and returning 2322 the slip ring 152 to a position that does not trigger a sensing of rotation of the slip ring 152.

Those skilled in the art will recognize that a wide variety of modifications, alterations, and combinations can be made with respect to the above described embodiments without departing from the scope of the invention, and that such modifications, alterations, and combinations are to be viewed as being within the ambit of the inventive concept.

What is claimed is:

1. A movable barrier operator comprising:

a motor coupled to a movable barrier to effectuate movement of the movable barrier;

a computing device configured to control movement of the motor;

a manual drive operably coupled to the movable barrier to effectuate movement of the movable barrier;

a slip ring operably coupled to move with the manual drive along a portion of a rotation of the manual drive in a first direction until the slip ring engages a detent and to not move with the manual drive during further rotation of the manual drive in the first direction;

at least one sensor configured to sense rotation of the ring and, in response to sensing the rotation of the ring, to communicate a signal to the computing device, wherein in response to receiving the signal, the computing device is configured to prevent operation of the motor to effectuate movement of the movable barrier.

2. The movable barrier operator of claim 1, wherein the slip ring comprises an elastic ring terminating at two ends that are connected by a spring, the elastic ring having a diameter configured to engage a rotatable portion of the drive mechanism, and the spring configured to bias the elastic ring to engage the rotatable portion of the drive mechanism with sufficient force to frictionally engage the rotatable portion such that the slip ring rotates with the rotatable portion but is slidable over the rotatable portion in response to the slip ring's engaging the detent.

3. The movable barrier operator of claim 1, wherein the at least one sensor is configured to sense direction of rotation of the manual drive, and, in response to sensing the direction of the rotation, to communicate a signal including an indication of direction of the rotation of the manual drive to the computing device.

4. The movable barrier operator of claim 3, wherein the computing device is configured to determine, in response to receiving the indication of direction of rotation, a first direction of operation of the motor after operation of the manual drive.

5. The movable barrier operator of claim 4, wherein the manual drive is configured to rotate after manual operation such that the slip ring returns to a position that does not trigger the at least one sensor to sense rotation of the slip ring when the manual drive is not engaged to move the movable barrier.

6. The movable barrier operator of claim 1, wherein the at least one detent is configured to engage a portion of the slip ring to stop rotation of the slip ring after the at least one sensor senses the rotation of the slip ring such that the slip ring slides over the rotatable portion of the drive mechanism while the rotatable portion continues to rotate in response to operation of the manual drive.

7. An apparatus for controlling motor drive states of a movable barrier operator during and after operation of a manual drive mechanism, the apparatus comprising:

a slip ring configured to engage a rotatable portion of a drive mechanism that rotates along a portion of a rotation of a manual drive portion of the drive mechanism used to move a movable barrier until the slip ring engages a detent and to not move with the manual drive during further rotation of the manual drive; and at least one sensor configured to sense rotation of the slip ring and in response to sensing the rotation of the ring, to communicate a signal to a computing device, wherein the computing device is configured to prevent operation of a motor of the drive mechanism to move the movable barrier in response to receiving the signal.

8. The apparatus of claim 7, wherein the ring comprises a slip ring comprising an elastic ring terminating at two ends that are connected by a spring, the elastic ring having a diameter configured to engage the rotatable portion of the drive mechanism, and the spring biasing the elastic ring to engage the rotatable portion of the drive mechanism with sufficient force to frictionally engage the rotatable portion such that the slip ring rotates with the rotatable portion but is slidable over the rotatable portion in response to the slip ring's engaging the detent.

9. The apparatus of claim 7, wherein the at least one sensor is configured to sense direction of rotation of the manual drive, and, in response to sensing the direction of the rotation to communicate a signal including an indication of direction of the rotation to the computing device.

10. The apparatus of claim 9, wherein the computing device is configured to, in response to receiving the indication of direction of rotation of the slip ring, determine a first direction of operation of the motor after operation of the manual drive.

11. The apparatus of claim 10, wherein the manual drive is configured to rotate after manual operation such that the slip ring returns to a position that does not trigger the at least one sensor to sense rotation of the slip ring when the manual drive is not engaged to move the movable barrier.

12. The apparatus of claim 7, wherein the detent is configured to engage a portion of the slip ring to stop rotation of the slip ring after the at least one sensor senses the rotation of the slip ring such that the slip ring slides over the rotatable portion of the drive mechanism while the rotatable portion continues to rotate in response to operation of the manual drive.

* * * * *